US010993882B2

(12) United States Patent
Patel et al.

(10) Patent No.: US 10,993,882 B2
(45) Date of Patent: May 4, 2021

(54) PILL CONTAINER WITH REMOVABLE TABS AND MAGNIFYING GLASS

(71) Applicants: Miteshkumar Ishwarbhai Patel, San Leandro, CA (US); Raj Kalpesh Patel, San Jose, CA (US)

(72) Inventors: Miteshkumar Ishwarbhai Patel, San Leandro, CA (US); Raj Kalpesh Patel, San Jose, CA (US)

( * ) Notice: Subject to any disclaimer, the term of this patent is extended or adjusted under 35 U.S.C. 154(b) by 152 days.

(21) Appl. No.: 16/368,089

(22) Filed: Mar. 28, 2019

(65) Prior Publication Data

US 2019/0216686 A1 Jul. 18, 2019

Related U.S. Application Data

(63) Continuation of application No. 15/729,637, filed on Oct. 10, 2017.

(51) Int. Cl.

| | |
|---|---|
| ***A61J 7/04*** | (2006.01) |
| ***B65D 50/04*** | (2006.01) |
| ***A61J 1/03*** | (2006.01) |
| ***A61J 7/00*** | (2006.01) |

(52) U.S. Cl.

CPC . *A61J 7/04* (2013.01); *A61J 1/03* (2013.01); *A61J 7/0076* (2013.01); *B65D 50/046* (2013.01); *A61J 2205/00* (2013.01); *A61J 2205/60* (2013.01)

(58) Field of Classification Search

CPC .. A61J 7/0076; A61J 2205/00; A61J 2205/60; A61J 7/04; A61J 1/03; B65D 50/046; B65D 50/048; B65D 2251/09

USPC ..... 206/534; 215/221, 330, 217, 209, 219; 220/254.8

See application file for complete search history.

(56) References Cited

U.S. PATENT DOCUMENTS

| | | | | |
|---|---|---|---|---|
| 2,961,108 A * | 11/1960 | Johnson | B65D 51/24 | 215/228 |
| 3,367,484 A * | 2/1968 | Nelson | B65D 51/28 | 206/540 |
| 4,103,797 A * | 8/1978 | Morris | B65D 50/046 | 215/209 |
| 4,427,124 A * | 1/1984 | Marshall | B65D 83/0454 | 215/216 |
| 4,753,189 A * | 6/1988 | Mastman | B65D 41/06 | 116/308 |
| 5,309,279 A * | 5/1994 | Halstead | A61J 7/04 | 359/442 |

(Continued)

*Primary Examiner* — Chun Hoi Cheung
(74) *Attorney, Agent, or Firm* — Creso Legal

(57) ABSTRACT

A pill container having removable tabs, a cap, and a magnifying lens is described. The cap can rotatably fit and lock with the housing of the pill container. The housing is a hollow cylinder that includes a flange having breakable tabs where each tab is labeled with an hour of administration (HOA) that identifies the time at which the medications are to be taken. The breakable tabs include perforations around them to allow for the breaking. The cap of the pill container contains a magnifying lens that allows its user to use by removing the cap and using it to view the label, the contents of the pill container, and other writings and items in an enlarged manner. The cap includes retention features that allow the insertion and removal of the magnifying lens. The magnifying lens can be replaced with another lens that matches their eyeglass prescription.

19 Claims, 13 Drawing Sheets

(56) References Cited

U.S. PATENT DOCUMENTS

| | | | | | |
|---|---|---|---|---|---|
| 5,660,138 | A * | 8/1997 | Hirsch | A61J 7/04 | 116/308 |
| 5,711,442 | A * | 1/1998 | Kusz | B65D 50/046 | 215/209 |
| 5,760,975 | A * | 6/1998 | DiGiovanni | B65D 51/24 | 359/802 |
| 5,899,348 | A * | 5/1999 | Konefal | B65D 50/046 | 215/209 |
| 6,036,017 | A * | 3/2000 | Bayliss, IV | A61J 1/03 | 206/459.5 |
| 6,386,367 | B1 * | 5/2002 | Bayliss, IV | A61J 1/03 | 206/459.5 |
| 6,772,902 | B1 * | 8/2004 | White | B65D 43/162 | 215/201 |
| 7,942,280 | B2 * | 5/2011 | Priebe | B65D 50/046 | 215/217 |
| 7,978,564 | B2 * | 7/2011 | De La Huerga | E04C 5/12 | 368/10 |
| 10,085,918 | B1 * | 10/2018 | Dartt | A61J 7/0076 | |
| 2005/0150805 | A1 * | 7/2005 | Burchell | B65D 51/28 | 206/534 |
| 2010/0126955 | A1 * | 5/2010 | Robinson | B65D 50/046 | 215/216 |
| 2012/0223045 | A1 * | 9/2012 | Burke, Jr. | A61J 7/0472 | 215/228 |
| 2017/0139216 | A1 * | 5/2017 | Crenko | G02B 27/02 | |
| 2017/0139217 | A1 * | 5/2017 | Crenko | G02B 27/027 | |

* cited by examiner

PILL CONTAINER WITH REMOVABLE TABS AND MAGNIFYING GLASS

INCORPORATION BY REFERENCE

Patent application Ser. No. 15/729,637 filed on Oct. 10, 2017, having a title, "Method and Apparatus for a Pill Container with Removable Tabs," is hereby incorporated by reference. This patent application being filed and earlier mentioned patent application having Ser. No. 15/729,637 have common ownership. Additionally, this application relates to Claims 9-15 of the originally filed application Ser. No. 15/729,637; these claims were subject to a restriction requirement and are being pursued herein.

BACKGROUND OF THE INVENTION

Field of the Invention

This application is related to pill container having removable tabs, a cap, and a magnifying lens.

Discussion of the Related Art

Doctors may prescribe several medications that are in form of pills for their patients. The pills are to be taken in a particular dosage regimen and the dosages are typically for a certain number of days depending upon the specific need and regimen required to cure their illness or to sustain their ongoing treatment, for example, a doctor may prescribe a medication to be taken for 7, 14 or even 30 days. These large numbers of pills, medications, and or vitamins may be in the form of pills, caplets, capsules, and or tablets. The pills are bottled by Pharmacy or a Medical Pill Dispensing Units in a vial. The vial is simply a container for holding pills.

The regimens may require the patient to take the pills in the vial, on a specific day or a specific time. For example, regimens may require the pills to be taken once a week or twice a week or to be taken daily in the morning. To remember these days and times, various reminders are provided by the pharmacies as well as the vial manufacturers. These reminders include labels on the vial bottle or even a dial reminder that includes a very small print of the days and times for the pill to be taken.

One method used in the past to provide a reminder is described in U.S. Pat. No. 820,169B1 (The '169 patent), Pill intake reminder and container cap device and method of use thereof. The '169 patent provides a dial that is part of the cap and the dial is labeled with days of the week as a reminder to the patient. The cap contains compressions that are labeled with the days of the week. There are several problems with this approach. First, the labeled dial with the reminder is part of the cap. Since caps can be detached from the main body of the pill container, it's easy to lose the cap or accidentally place a cap from one vial onto another vial that could result in the patient to take the wrong medication. Second, the labeling is in small print and hard to read by the patient. Third, the compressions are not easily identifiable and cannot be quickly assessed to determine whether the pills are meant for a Tuesday or a Wednesday when the Wednesday label may be compressed causing the patient to take a closer look. Yet another disadvantage is that patients of old age or patients with severe illness have limited judgement due to several medical reasons. Likewise, patients that are blind or partially blind patient may not be able to independently identify the vial without having additional help. Further, the invention of the '169 patent does not provide such patients a simple or easy solution to just touch the vial by their fingers and determine the contents as well as the times of the day for the pill to be taken. Instead, it requires them to pay close attention to detail, ask for help from others, or use glasses to read and select the right vial—which in many instances is not possible for them.

Other approaches to provide reminders use digital readout, are clunky, difficult to manufacture or costly. Also, due to the form factor of the vials, which are typically small, the labeling used is also small and hard to read thereby causing additional hardship to the patients. Additionally, prior art reminders that have attachments to the cap also suffer from the disadvantage of being broken off or the labeling being stripped off and cause confusion as determine the regimen for the pills in that vial. As such, there is a need for a vial that is easily identifiable and eliminates confusion for easy identification of the regimen of the pills inside the vial.

SUMMARY OF THE INVENTION

According to the disclosed embodiments, a pill container having removable tabs, cap and a magnifying glass are disclosed.

The pill container is part of a pill container assembly that includes a pill container housing and a cap. The cap can be fitted on the pill container by rotating it about the threads of the pill container housing to fit and lock with the housing of the pill container.

The housing is a hollow cylinder having a wider opening at the top and a narrower enclosed bottom and a cylindrical and tapered body in-between. The housing includes a flange that has a section for breakable tabs. Each of the breakable tabs is labeled with an hour of administration (HOA) that identifies the HOA for the medications that are to be stored within the pill container. The breakable tabs include perforations around them to allow a force to be applied such that they break along the lines of the perforation.

The housing also includes a locking feature that is a push and release tab that protrudes outwards from the flange. In operation, to remove the cap from the pill container, the user would push down on the push and release tab as well as untwist the cap from the pill container.

The top of the cap can be a solid material that is flat or beveled. Alternatively, the top of the cap can include a magnifying lens that is either plastic or glass. The cap may have features that allow magnifying glasses of different thickness and opacity to be inserted and fitted or the cap and pre-fitted magnifying glass may come as one piece that is not removable. The magnifying lens is used to see through and magnifies any writing or object that is on the other side of the magnifying lens. In use, an individual can detach the cap from the pill container and use it to magnify labels or other writing on the pill container for a magnified view. In its closed position on the pill container, it also depicts the pills inside to show them magnified. The magnification helps in easy reading or detecting of pills.

A tab removal machine can be used for removing the removable tabs from the pill container. For example, a tab removal machine, such as in patent application Ser. No. 15/729,637 can be used. The tab removal machine may use a method for removing a tab from the pill container that includes receiving the pill container in the circular protrusion of the base plate. Locking the pill container within the circular protrusion by having the circular protrusion wrap along the bottom of the pill container as well as inserting an alignment protrusion inside the hole of the pill container to restrict it in the XY plane. The system then determines the hours of administration (HOA) for the pills that are to be stored in the pill container by querying a database to obtain the HOA. The HOA is specific for each patient and the medications that are to be taken by that specific patient that are stored in the pill container that is being processed. Based upon the data received, the tab removal machine determines which tabs are applicable and which tabs are not being used by the patient. For the tabs that are not being used, the tab removal machine removes them, or pinches them out, from the pill container such that only the tabs that are to be used remain.

The breaking of the tab occurs by applying pressure to the tab using a movable protruding arm of the tab breaking mechanism, thereby resulting in the tab being broken away from the flange along the lines of perforations.

BRIEF DESCRIPTION OF THE DRAWINGS

The accompanying drawings are included to provide further understanding of the invention and constitute a part of the specification. The drawings listed below illustrate embodiments of the invention and, together with the description, serve to explain the principles of the invention, as disclosed by the claims and their equivalents.

Figure 1:
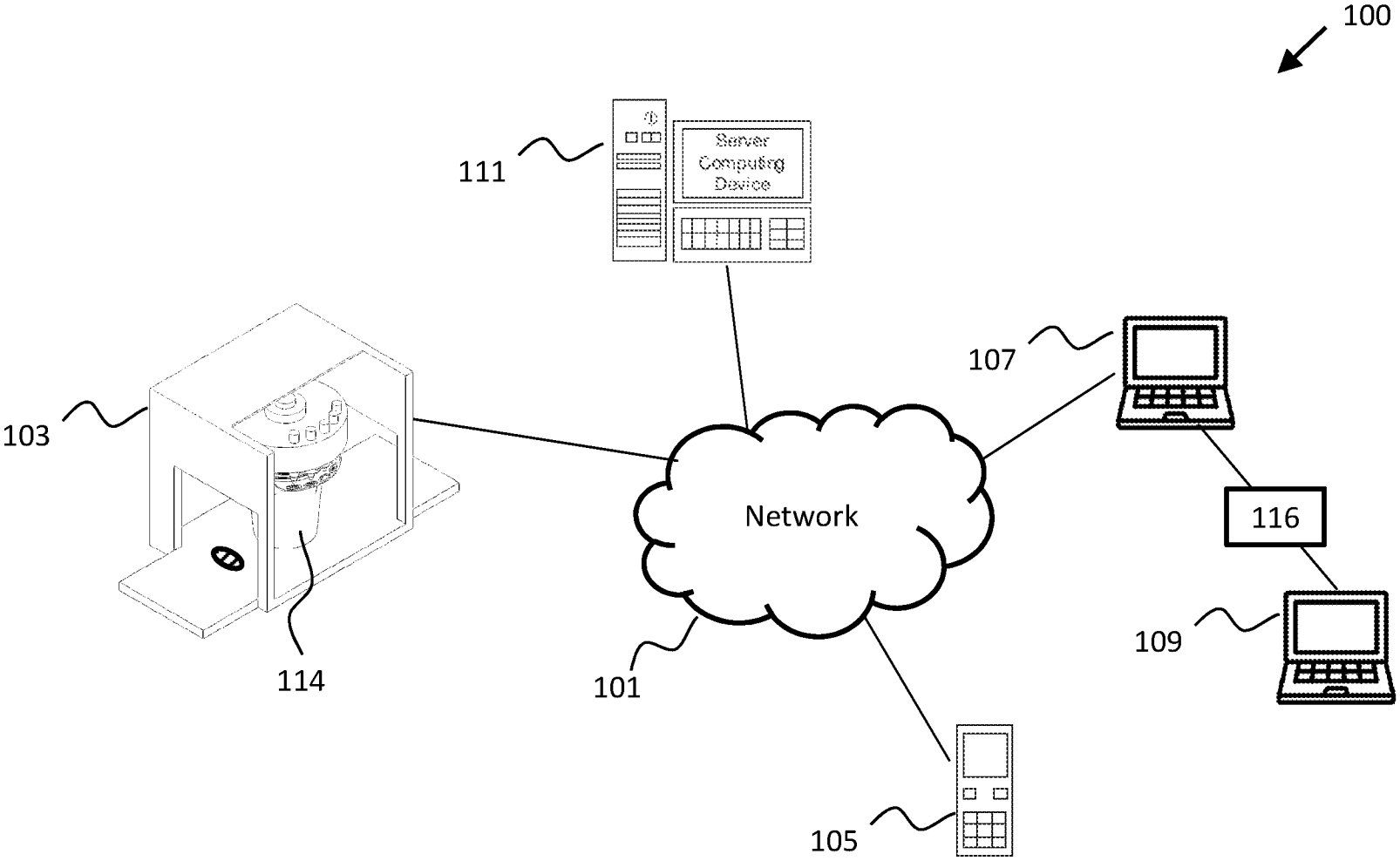
FIG. 1 is a system for selectively removing tabs from a pill container having removable tabs, according to the disclosed embodiments.

While the embodiments of the application are susceptible to various modifications and alternative forms, specific embodiments are provided as examples in the drawings and detailed description. It should be understood that the drawings and detailed description are not intended to limit the embodiments to the particular form disclosed. Instead, the intention is to cover all modifications, equivalents and alternatives falling within the spirit and scope of the invention as defined by the appended claims.

DETAILED DESCRIPTION

Aspects of the invention are disclosed in the accompanying description. Alternate embodiments of the present invention and their equivalents are devised without parting from the spirit or scope of the present invention. It should be noted that like elements disclosed below are indicated by like reference numbers in the drawings. While the embodiments discussed below describe a pill container with removable tabs, a tab removable machine for removing the removable tabs, and a method for removing the removable tabs, these approaches are not so limited and equally applicable to other variations.

FIG. 1 depicts a system for selectively removing tabs from a pill container having removable tabs. System 100 includes a network, a tab removing machine, client computers, a handheld device, and a server computing device.

The network may be local area networks (LAN), wide area network (WAN), or a wireless network. It may be configured to connect directly or remotely to other networks as well as to a tab removing machine 103, a handheld device 105, client computing devices 107 and 109, and/or a server computing device 111.

Client computing devices 107 and 109 may include any device capable of receiving and sending data over the network 101. Handled devices 105 may include portable devices such as cellular telephones, smart phones, radio frequency-enabled devices, personal digital assistants, handheld computers, tablets, wearable computers and the like. Handheld device 105 may include any computing device that connects to a network using a wired communications medium such as personal computers, processors, multiprocessor systems, microprocessor-based or programmable consumer electronics, network personal computers and the like. Handheld device 105 may also connect wirelessly to other electronic devices through various mediums, such as Bluetooth and other similar modes.

Network 111 may be configured to communicate with server computing device 111 or additional servers in or outside the network.

FIG. 1 show details of one exemplary tab removal machine that can be used to remove the tabs from the pill container. The tab removing machine 103 communicates with all the components in the system 100 either directly, through the network 101, or through network and any one of its components, such as through the server computing device. The tab removing machine 103 includes a space for placing a pill container having removable tabs 114. The pill container having removable tabs 114 is used for housing medications, such as tablets, capsules, or any other solid medication. Alternatively, the pill container may also be configured to house liquid medication.

In one embodiment, the tab removing machine 103 communicates with the client computing devices 107 and 109 (either directly, through network 101, or through server computing device 111). The communications between the tab removing machine 103 and the client computing devices allow the client computing devices 107 and 109 to direct the operation of the tab removing machine 103.

For example, the client computing devices 107 and 109 may direct operations of the tab removing machine 103, provide data to the tab removing machine 103 for it to make certain decisions, or verifications, such as a verification that the pill container 114 placed within the tab removing machine 103 is the associated with a specific patient, or corresponds to a specific prescription for a specific patient, and approved for further processing.

Computing device 109 is configured to generate and/or modify a prescription plan, along with its schedule of taking medications, and provide them to tab removing machine 103. In one embodiment, computing device 109 can execute (e.g., by using the one or more processors) a plan generation module 116 to access, generate, and/or modify a plan 116. Plan 116 indicates a pill distribution schedule and the type of medications to be taken by a specific patient. Plan 116 is then communicated to tab removing machine 103, which can be executed by computing device 107 (e.g., by using one or more processors). Using these plans are then used by the tab removing machine 103 to make certain determinations and then to remove certain tabs from the pill container 114 that are not in the plan. For example, after obtaining a prescription plan that includes a pill taking schedule for just morning time, the computing device 107 will direct the tab removing machine 103 to remove all tabs from the pill container 114 and leave behind the tab associated with morning thereby making it convenient for a patient or caregiver to easily associate the pill container 114 for a morning pill intake regimen.

In addition to the above, the embodiments described herein, including systems, methods/processes, and/or apparatuses, may be implemented using well known servers/computers shown in FIG. 1. These servers, computers, or even the tab removal machine, which may include its own onboard computer, includes one or more processors (e.g., central processing units (CPUs)). The processor can simultaneously operate multiple computing threads. The computer also includes a primary or main memory, such as a random-access memory (RAM) and control logic stored therein. The computer also includes one or more secondary storage devices. Secondary storage devices include, for example, a hard disk drive and/or a removable storage device or drive, as well as other types of storage devices, such as memory cards and memory sticks. For instance, the tab removal machine may also include hardware components that allow insertion of a removable storage device, or a USB device, to obtain the stored data therein. The stored data may be the details of each pill container processed, types and number of tabs removed etc. The system also includes control logic that may be transmitted to and from computer. For example, Control logic may be used to align the pill container with the tab breaking mechanism or to determine which tab to break. Additionally, the control logic may be used in any of the flowcharts or operations that require a decision-making step before processing a pill container or breaking a removable tab.

Various embodiments of communications between the various components of the system, selective removal of tabs, and the pill are described in further detail with reference to the Figures below.

Figure 2A:
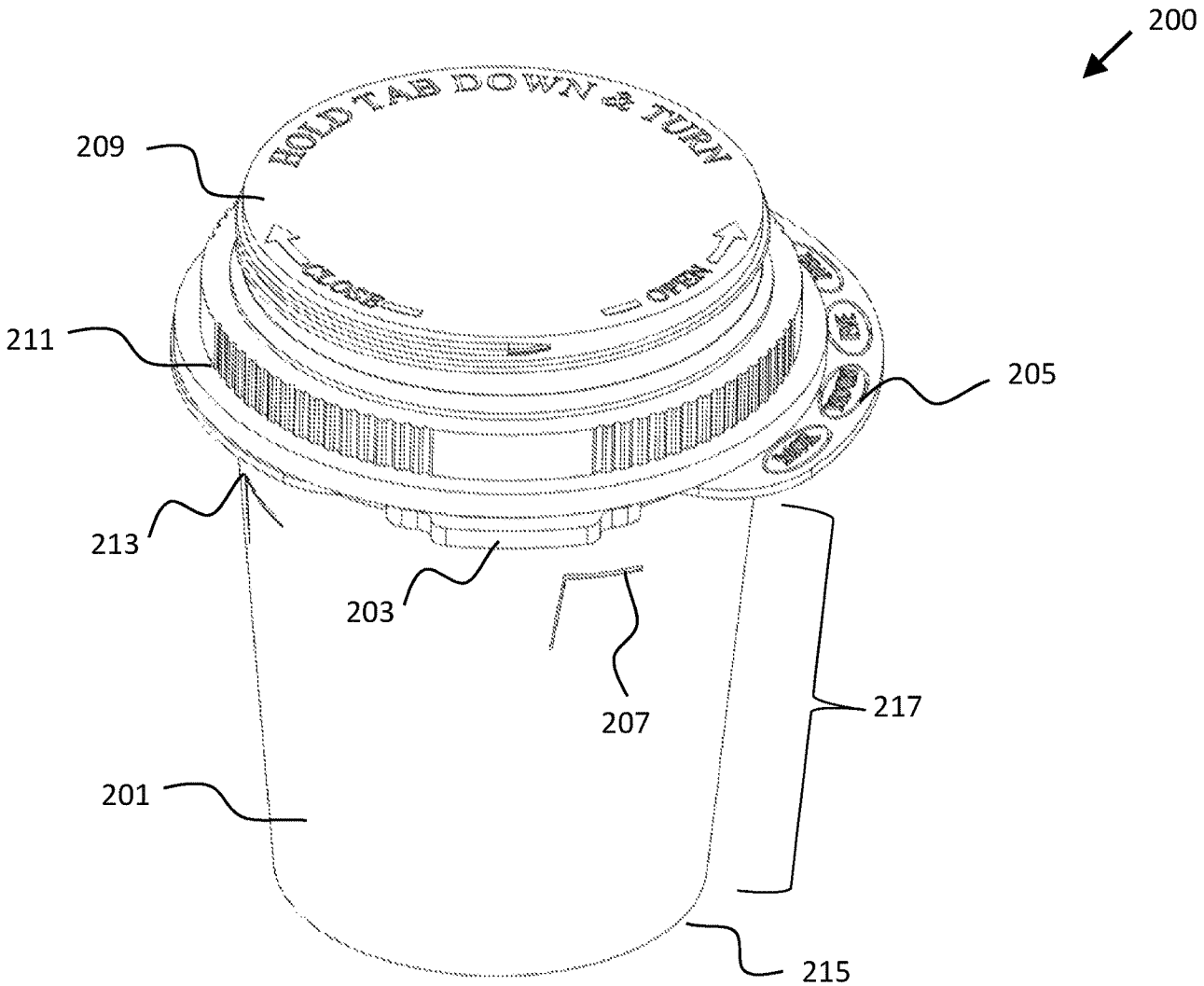
FIG. 2A is a perspective view of a pill container with removable tabs and a cap, according to the disclosed embodiments.

FIG. 2A is a perspective view of a pill container with removable tabs and a cap, according to the disclosed embodiments. The pill container 200 includes housing 201, a locking feature 203, a section for tabs 205, a label section 207, and a cap 209, together forming a pill container assembly. The cap includes external threads 211. The cap also includes internal threads that act as a locking mechanism. These internal threads are used for mating and connecting with threads from the housing 201 such that once the two threads are rotated about each other, the cap is tightened and locked in with the housing to form one housing-cap assembly. Further details of the pill container 200 and the pill container assembly are described with respect to its various embodiments as depicted through FIGS. 3-9, including showing its various front, top, bottom, and cross-sectional views. Various types of caps for the pill container assembly are described and depicted in FIGS. 2A, 2B, 2C, and 3.

The pill container assembly is used for storing medications such as pills, tablets, capsules, vitamins, or other forms or solid medication. Alternatively, the pill container assembly may also be used for storing liquid medication when a liquid protection seal is added to the cap. The pill container is also referred to as vial, pill vial, pill bottle, pharmacy bottle, pharmacy vial, plastic dram vial, prescription vials, or prescription bottles. Yet, in another embodiment, the vial may be used for certain skin application products that are used as a dermatological medicine and have the need to be applied on a certain day or time of the day.

The housing 201 of the pill container 200 includes an upper end section 213. This section has an opening, also referred to as a mouth, which is used for depositing and taking out medications. The upper end and the mouth have a wide opening and is also used for placing the cap 209 on the housing 201.

The housing 201 of the pill container 200 includes a lower or bottom end section 215. This section defines a bottom surface of the pill container 200. The bottom section is closed from below providing a floor or a base for the medication stored within the pill container 200.

The housing 201 of the pill container 200 has a surrounding wall 217. This wall extends from the upper end section 213 to the bottom end section 215 fully encapsulating the inside and defining an exterior surface and an interior surface for the housing 201 of the pill container 200.

The housing 201 of the pill container 200 is circular with the diameter of the upper end section 213 being wider than the diameter of the bottom end section 215. The wider top and the narrower bottom results in creating a tapered tubular body. The variance between the diameters of the upper mouth and the floor of the housing 201 may vary as desired. The variance would also dictate the angle of the surrounding wall 217. As will be further explained below, the angle of this tapered tubular section allows stacking of multiple pill containers within each other. The wider top and narrower bottom configuration also assists in a better grip for the user in holding the pill container in their hands.

The upper end section 213, i.e. the mouth of the housing 201, includes a flange that extends radially from the surrounding wall 217. This flange extends around a portion of the outer circumference of the upper end section 213 that is closer to the mouth/opening of the housing 201. The flange includes the locking feature 203, a section for tabs 205, and an engagement surface for engaging with the cap 209.

The flange's engagement surface can engage with the cap 209 in a similar fashion as a screw and bolt. For example, the engagement surface may be threaded to receive a cap through which a cap can be rotatably inserted and tightened with respect to the housing 201. Once the cap 209 is tightened with the housing 201 through these threads, the assembled pill container would form a seal at the mouth thereby preventing any debris from entering the pill container. Alternatively, the seal may also be leak proof in the event of any liquid medication being housed inside the pill container 200 and water and liquid proof from the outside preventing any liquid from entering the pill container 200.

The cap 209 also includes external threads 211. The external threads allow the user to grip the cap 209 such that they may exert force clockwise or anti-clockwise without their grip slipping from the cap 209. The external threads 211 also make it easy to open the bottle when the user's hands are greasy, oily, or require an additional grip.

As mentioned above, the housing 201 of the pill container 200 includes a locking feature 203. This locking feature is part of the flange. In one embodiment. The locking feature is a push and release tab that protrudes outwards from the external surface of the surrounding wall. This push and release tab is located in the upper end section 213 and near the opening or mouth at the top. In operation, in order to open the cap 209 from the housing 201, the user may have to push down on the cap and untwist the cap 209 to unlock or push on the push and release tab, untwist the cap 209 while keeping the push and release tab pushed in until it surpasses a locking point and then release the push and release tab resulting in removal of the cap 209 from the housing 201. Basically, the push and release tab 203, also referred to as the locking feature, functions to release the cap 209 from the housing 201 from its locked state.

The locked state refers to the cap 209 being tightly placed on the housing 201 such that it cannot be opened by a child, also referred to as "child resistant lock". This implies that in order to open the cap from this child safety status, a dual operation needs to be performed at the same time to unlock the structural elements and that usually requires coordination, skill, strength that is atypical of what a child under a certain age possesses thereby making it child safe.

The child safety mechanism protects children from accidental poisoning by intake of the medication housed in the housing 201 so that a child may not without adult supervision, on their own, ingest, inhale, drink, or spray, the medication of chemical-based goods into their mouth or any part of their body. So, while the cap 209 becomes childproof, the skill required to open the cap and unlock the safety feature is still within capable reach of certain adults with disabilities so they may still be able to open it.

The flange also includes a section for tabs 205. These tabs 205 are removable or breakable. This tabs section 205 may include a plurality of tabs that are labeled with various hours of administration (HOA). As you know, doctors and/or authorized medical professionals typically prescribe medications for a specific patient that are to be administered at a certain time of the day, such as morning, afternoon, evening, night or a selected time frame. These times for intake of medication are referred to as hours of administration (HOA). As such, the tabs in the tabs section 205 are also labeled accordingly as morning, afternoon, evening, night or a selected time frame or any combination thereof. For example, one pill container 200 may have just 4 tabs, morning, afternoon, evening, night and another pill container may have 3 tabs, morning, afternoon, evening or any such combination. Each tab corresponds to the contents/medications stored within the pill container and provides guidance to the user/patient for whom the medications are prescribed that the patient should take the medication in that HOA.

For example, if among the plurality of tabs in the tabs section 205, only a tab labeled morning remains after processing of the pill container, then the morning tab signifies and provides guidance to the patient that the medication within is to be administered in a morning time slot.

As will be explained in further detail below, these tabs 205 are selectively removable or breakable by a tab removal machine. So, in an embodiment where the tabs included at the initial stage are morning, afternoon, evening, night and that pill container is to be filled with medication that is to be taken only in the morning time, then the other tabs (afternoon, evening, night) are removed from the tabs section 205.

The tabs have a series of perforations around them that allows them to be removed or broken away from the tab section 205 when a certain amount of pressure is applied. The pressure is significant enough that it prevents accidental breaking by a user but also within the scale and reach of the tab removal machine to be pressed and broken away.

Once the tabs that are not relevant to the particular patient, i.e. for their morning pills, are removed through processing, then the only tab that remains is the morning tab making it discernable by the patient or their caregiver that the entire bottle is for medications to be taken in the morning. Likewise, multiple tabs, such as morning and evening, or any such combination of tabs that remain on the pill container 200 signify that the pill container 200 contains medications that are to be taken both morning and evening thereby making it easy to identify and reducing patient intake error.

Figure 2B:
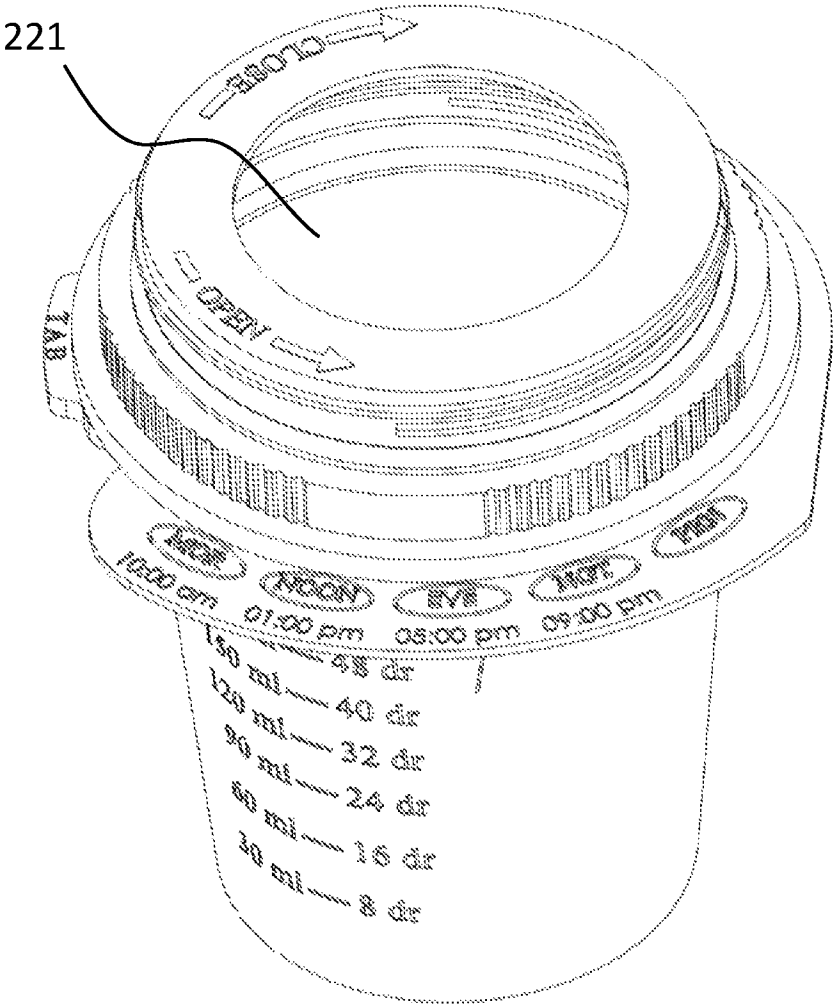
FIG. 2B is a perspective view of a pill container with removable tabs and a cap having a magnifying lens, according to the disclosed embodiments.

FIG. 2B is a perspective view of a pill container with removable tabs and a cap having a magnifying lens, according to the disclosed embodiments. This embodiment shows the cap 209 having a magnifying lens 221. The magnifying lens or glass is fitted and part of the cap's top surface. The magnifying lens is attached such that it becomes part of the cap 209 and cannot be removed from the cap in its ordinary course of use. Certain detents, protrusions, and rails can be molded inside the cap to ensure the magnifying lens is retained on its top surface and doesn't come out easily to prevent it from falling down or detaching from the cap. The magnifying lens may be of different diameter and thickness. It may also be special ordered for a certain level of magnification or to provide a certain level of viewing that matches an individual's prescription glasses.

Although the figures depict an assembly showing a magnifying glass attached to the top of the cap, other attachment and manufacturing alternatives are also contemplated. For example, in one embodiment, the Cap and the Magnifying glass may be produced as one piece during the manufacturing process. Other alternative attachment means, where a magnifying glass can be retrofitted, replaced with other magnifying glasses of various thickness and opacity, press fitted, screwed into the cap, or have threads that mate with the inside of the cap is also contemplated. In yet another embodiment, the cap may include a sleeve for sliding in the magnifying glass and having a press fit mechanism that captures and holds the glass in place once fully inserted into the sleeve. Various shapes of magnifying glass, such as circular, oval, elliptical, square, rectangular and other shapes are also contemplated. The cap may also include a thin plastic cover that protects any scratches or dents to the magnifying glass.

As mentioned above, in another embodiment, the cap may also contain a mechanism that allows the detaching of the magnifying lens from the cap such that it can be replaced with another magnifying lens if needed. In case of glass or plastic shattering or breaking for any reason, or if a higher level of magnifying lens is needed, the individual can remove the magnifying lens by pressing certain mechanisms to detach the magnifying glass from the cap and replace it with another one.

Figure 2C:
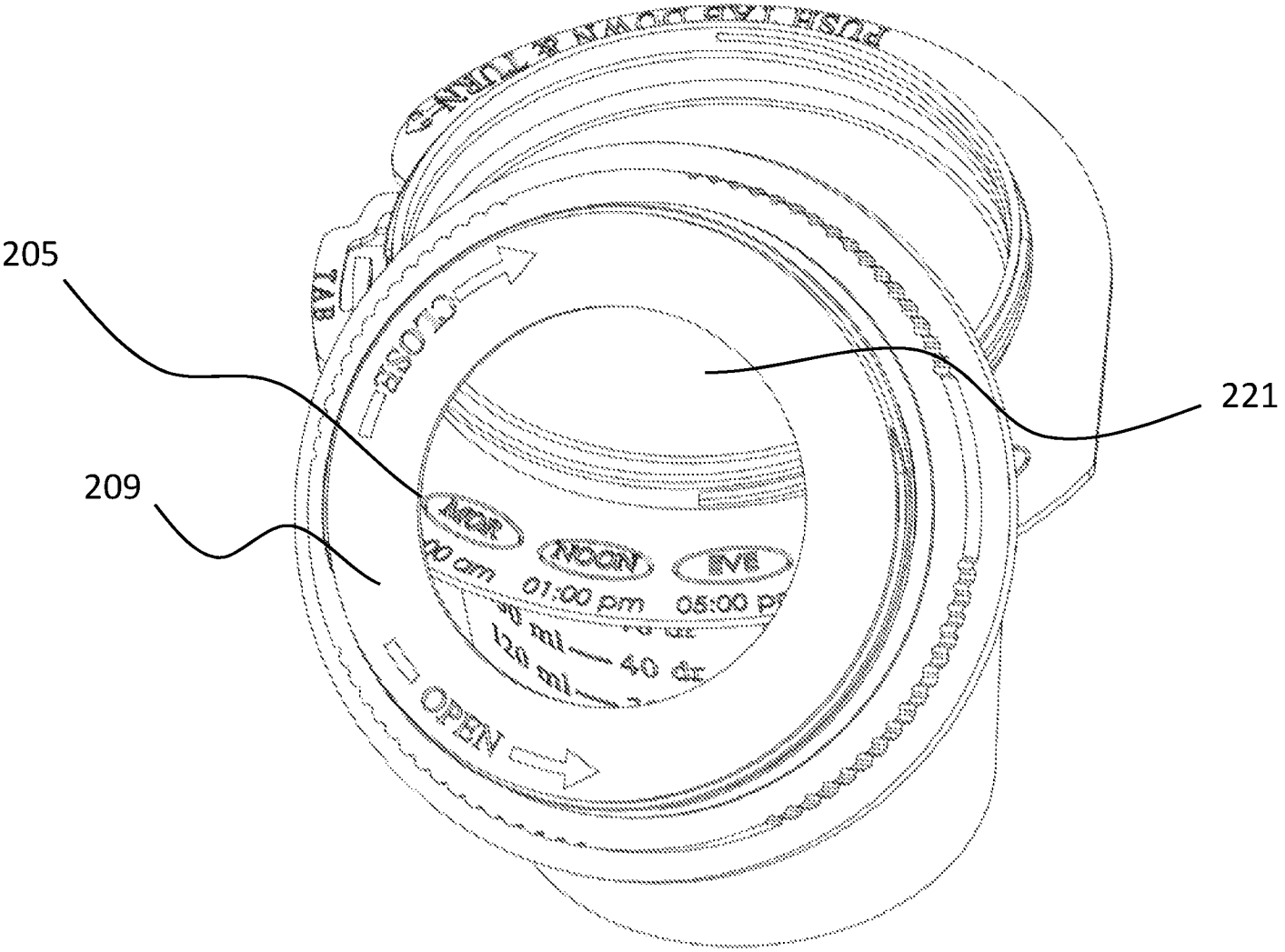
FIG. 2C is a perspective view of a pill container with removable tabs and a cap that is shown detached from the pill container, the cap having a magnifying lens and being used to magnify the text on the pill container, according to the disclosed embodiments.

FIG. 2C is a perspective view of a pill container with removable tabs and a cap that is shown detached from the pill container, the cap having a magnifying lens and being used to magnify the text on the pill container, according to the disclosed embodiments. In this embodiment, the cap 209 is detached from the pill container and its magnifying glass 221 that is part of the cap 209 is used to magnify the writing in the section for tabs 205. The magnification allows for easier reading, especially for those that have prescription glasses or weak eyesight. Rather than having to obtain other magnifying means, such as a pair of prescription glasses, or seek help from others, individuals with weak eyesight, or those that can use magnification, can now easily detach the cap, see through the magnifying glass 221 and read the label, tabs, and view the pills in a magnified and enlarged view.

In yet another embodiment, the cap may contain a sealing feature, such as a rubber-like material, to seal the contents inside the pill container once it is closed.

Figure 3:
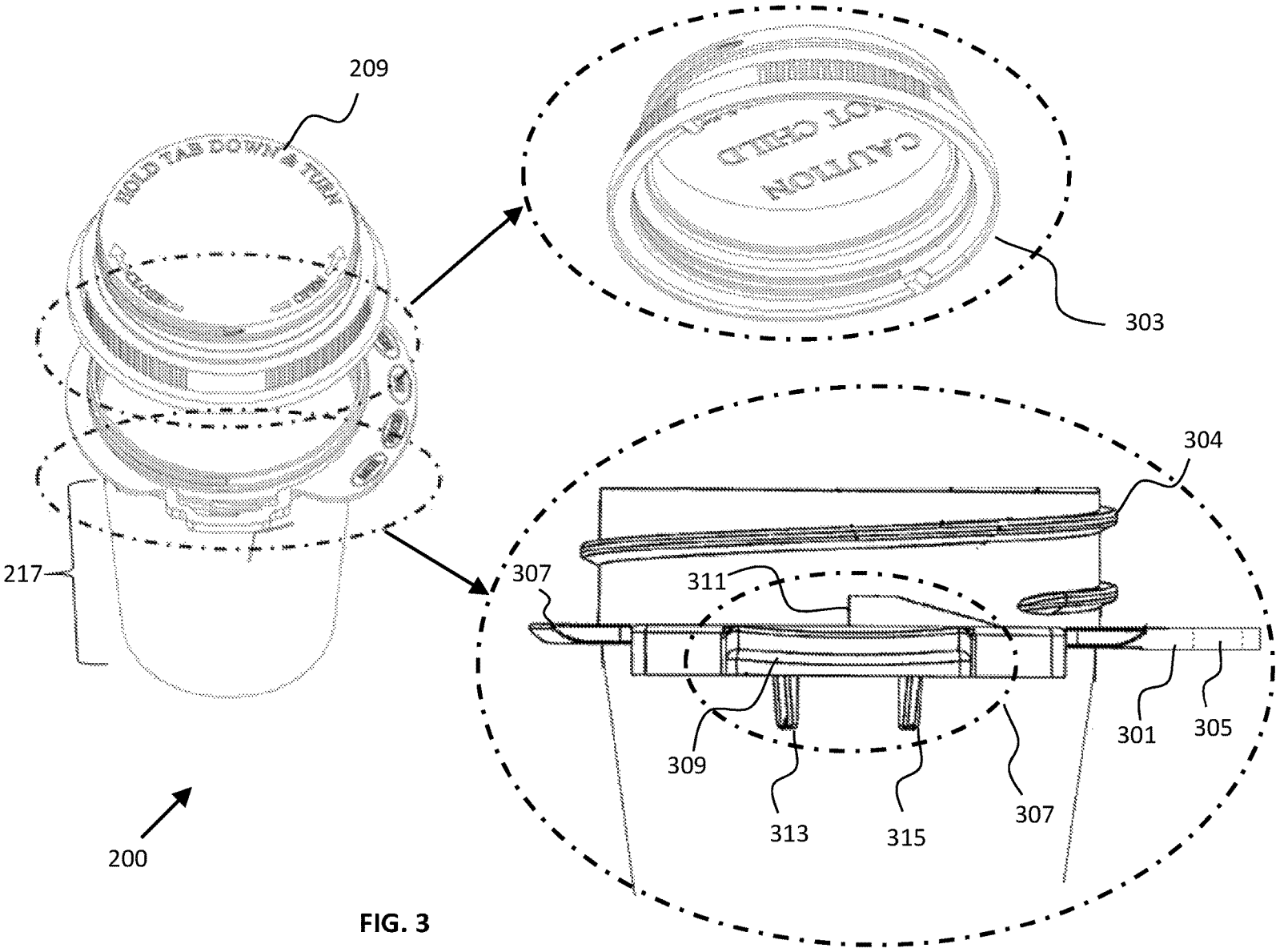
FIG. 3 is a perspective view depicting the pill container along with detailed views of its engagement sections, according to some of the disclosed embodiments.

FIG. 3 is a perspective view depicting the pill container along with detailed views of its engagement sections, according to some of the disclosed embodiments.

The pill container 200 includes a flange 301. The flange 301 extends outwards from the surrounding wall 217. It surrounds a portion of the surrounding wall 217. Alternatively, the flange radially extends and surrounds the entire surrounding wall forming a circumference. Some portion of this radial and circumferential protrusion 301 also includes an engagement means. This engagement means can engage with the cap's 209 threaded inner rim surface 303 and allow the cap to rotate about the engagement means until it can come to a stop. The completed engagement between the cap and the engagement forms a seal between the housing and the cap which then prevents any solid object or debris from entering and any solid or liquid medications from escaping the pill container. The flange 301 also acts as a position stop to limit the amount of rotation of cap 209 mounted on the pill container 200.

The flange also includes a plurality of removable or breakable tabs. Each tab is surrounded by a plurality of perforations 305. The perforations 305 for each tab are spaced apart from the perforations for the neighboring tab. The perforations 305 allow for easy breaking or removal of the tab when pushed, punched, or applied force through various means. In the current embodiment, a plunger type protrusion, a stick, or any other protrusion that can apply a pointed force, or distributed force applied over an area of the tab. The applied force would result in breaking or removing the tab along its perforated lines. The perforations protect the flange by not having any other area break or crack while a pressure is applied to the tab and result in only the breaking of the tab. The perforations also prevent a neighboring tag from any damage or removal and only break the intended tab.

The pill container 200 includes a push tab mechanism 307. This mechanism is coupled to the flange 301 and protrudes outside the exterior surface of the pill container's housing 201 towards it top end. The push tab mechanism 307 includes an engagement member 309 and a locking member 311. The push tab mechanism 307 also includes a plurality of stops, such as first stop 313 and a second stop 315. These stop members prevent further engagement or over tightening of the cap 209 with the housing once a desired tightness of the cap with the pill container 200 is achieved. The push tab assembly 307 is mounted to the exterior surface of the surrounding wall 201 through protrusions. These protrusions are resilient or elastic members and allow bending of the push tab when pushed. The protrusions return to their original shape and orientation after a push force has been released from the push tab assembly 307. The push button is relatively smooth for providing a comfortable engagement and can be operated when a user pushes it with their finger.

The locking member 311 of the push tab is shaped as an inclined surface or a cam. It includes a locking edge 311. When mounting cap 209 to the pill container 200, a locking lug of the cap 209 engages and slides along an inclined edge surface and then drops behind the locking edge 311. Engagement between the locking edge 311 and other protrusions of the locking member with the cap 209 helps to prevent the cap 209 from rotating counterclockwise for removal or loosening from the pill container 200 thereby securing a tight lock as well as accidental removal of the cap 209.

Figure 4:
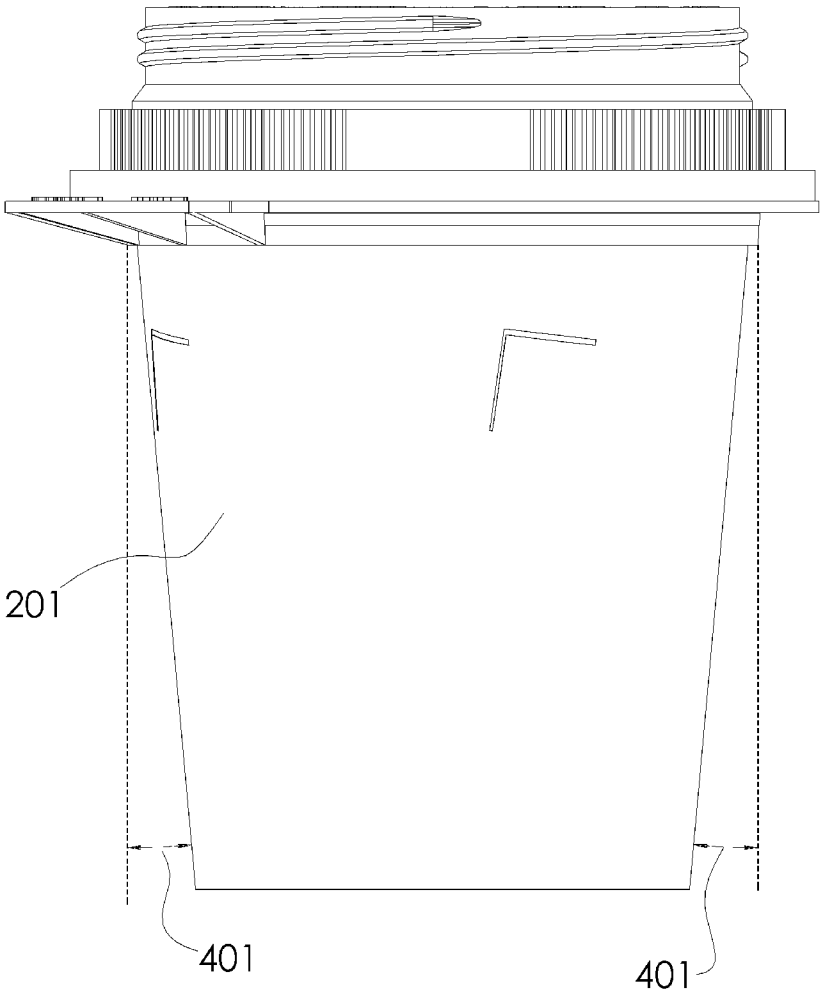
FIG. 4 is a front view of the pill container, according to some of the disclosed embodiments.

FIG. 4 is a front view of the pill container, according to some of the disclosed embodiments. As mentioned above, the housing 201 is tapered and cylindrical in shape. The tapering angle is constant and accomplished through a wider top section and a bottom section that is narrower in diameter than the top section as such resulting in the tapered body/middle section.

The angle of tapering can vary. A higher angle 401 will allow for a deeper taper. The deeper taper will result in a narrower bottom. A lower angle will allow for a straighter housing 201, i.e. the lower or smaller the angle the wider the bottom of the pill container. An angle that allows the maximum insertion of another same sized second pill container deep into and vertical closer to the bottom edge of the first pill container is preferred. Such taper will allow maximum stacking of pill containers leaving little gape between the bottoms of each pill containers. Stackability of one pill container into another pill container, thereby allowing a plurality of pill containers to be inserted into each will allow easy storage of the pill containers as well as reduce the storage space.

Figure 5A:
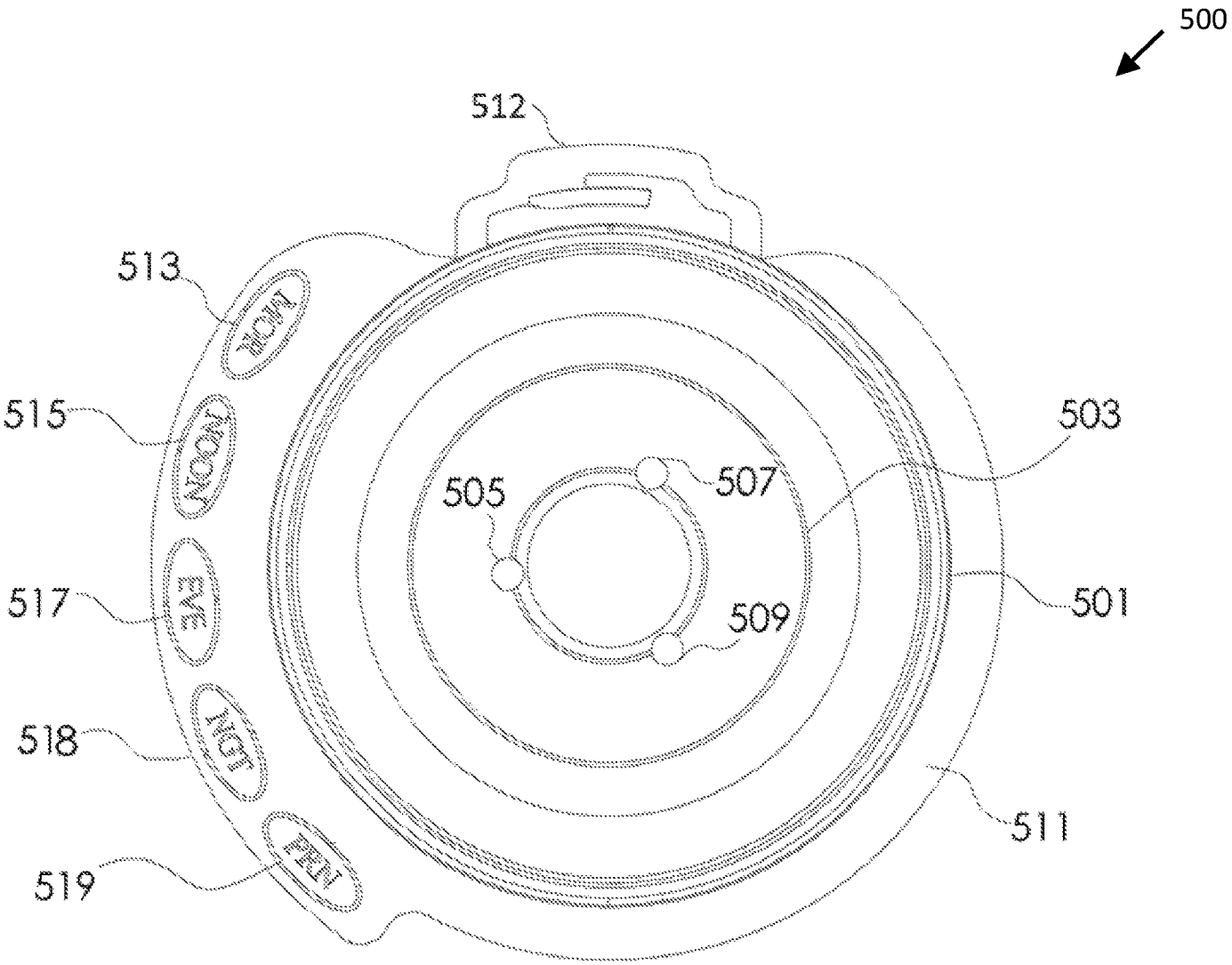
FIG. 5A is a top view of the housing of the pill container, according to some of the disclosed embodiments.

FIG. 5A is a top view of the housing of the pill container, according to some of the disclosed embodiments. The housing includes a flange 511. The flange extends radially outward from the housing 201. As mentioned above, the flange 511 includes the locking feature 203, a section for tabs 205, and an engagement surface for engaging with the cap 209.

The width of the flange 511 varies as it radially extends around the housing 201. For example, the width of the flange in the section of the flange 511 that does not include any additional features may be narrower than the width of the flange in the section where it includes the section for tabs 205 and the locking feature 203.

As part of the flange 511, the locking feature is a push and release tab 512 that protrudes outwards from the external surface of housing. The locking feature includes a flexible push and release mechanism that allows it to disengage from the cap 209 when it is pressed downwards and then reengage again with the cap 209 when it is released. In its released position, a protrusion in locking mechanism extends into the cap thereby preventing the cap from being detached from the housing 201 to prevent a child from opening the vial.

The pill container has a wider top, the mouth, and a narrower bottom. The wider mouth diameter 501 includes external threads that also engage with the cap 209. Acting as a dual locking feature, both the external threads 501 as well as the locking mechanism 512 (that protrudes from the flange) add extra protection to prevent accidental opening as well as child opening. In the case of a child, since a child below a certain age lacks the coordination and/or strength that is required for a dual locking feature, the press and release locking feature 512 as well as the external threads make it difficult for a child to open the vial by removing the cap from the housing.

The narrower bottom 503 is enclosed and has a narrower diameter than the mouth at the top. At the bottom center, the vial includes a plurality of small holes or indentations or detents. The holes appear on the outside of the vial and do not extend through into the inner side of the vial, i.e. there is no opening from inside of the vial from its bottom end to the outside. As such, the plurality of indents/holes extends into the body of the pill container but not so much that they create a passage therethrough. In one embodiment, the holes only extend about half the thickness of the overall plastic thickness at the bottom section. The plurality of holes are of the same size and diameter. The number of holes varies based on the size of the pill container. For example, a larger pill container that with a wider bottom, and a bigger diameter at the bottom, may include more holes than a narrower vial. Other variations, shapes of indentation, and number of indentations are also contemplated.

These holes/indentations or detents provide ease of manufacturing. They are also used by tab removal machine, as described in FIGS. 10, 11, and 12 to position the vial in a particular orientation and align it with respect to the tab removal machine for processing. Additional details of the use of these holes/indentation/detents is described are FIGS. 10, 11, and 12.

The flange 511 also includes a section for tabs 205. These tabs can be for times of day, days of week, or some customized tabs. For example, the flange includes tabs for Morning 513, Noon 515, Evening 517, Night 518 (not on fig), and PRN 519, where PRN 19 can be a customized tab for a specific patient. PRN is also a Latin term (pro re nata) that is used in the medical space and used as an abbreviation for "when necessary".

Each of the tabs 513-519 include a perforation around them allowing them to be easily broken off from the flange when a certain force is applied. The amount of force may vary but it would be higher than the force required to prevent accidental break off with very minimal force. For example, the pressure required may be 120 psi, which prevents accidental breaking off when touched by hand with a small force. Other measurements of force are also contemplated.

Figure 5B:
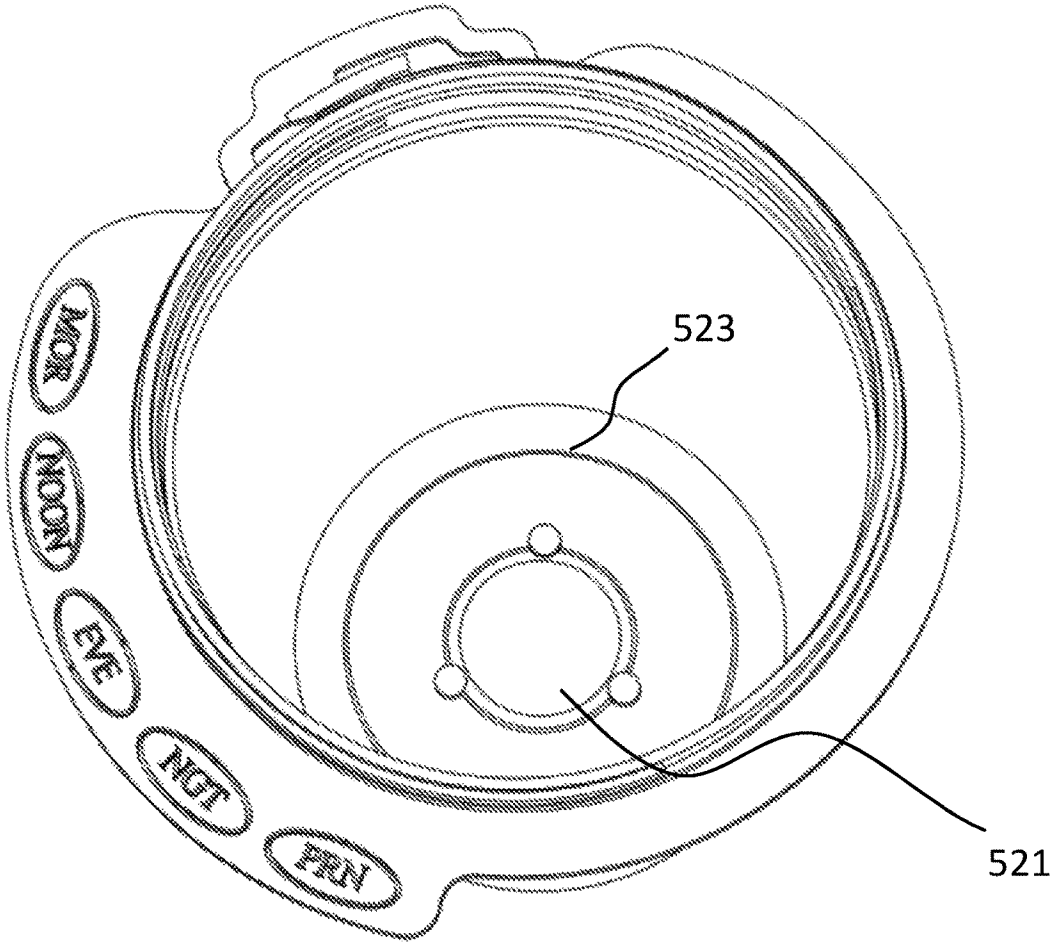
FIG. 5B is a top perspective view of the housing of the pill container, according to some of the disclosed embodiments.

FIG. 5B is a top perspective view of the housing of the pill container, according to some of the disclosed embodiments. In this embodiment, the bottom area of the pill container is raised from its periphery such that its center area 521 is raised higher and is tapered towards the periphery area closer to the edge 523.

Figure 6:
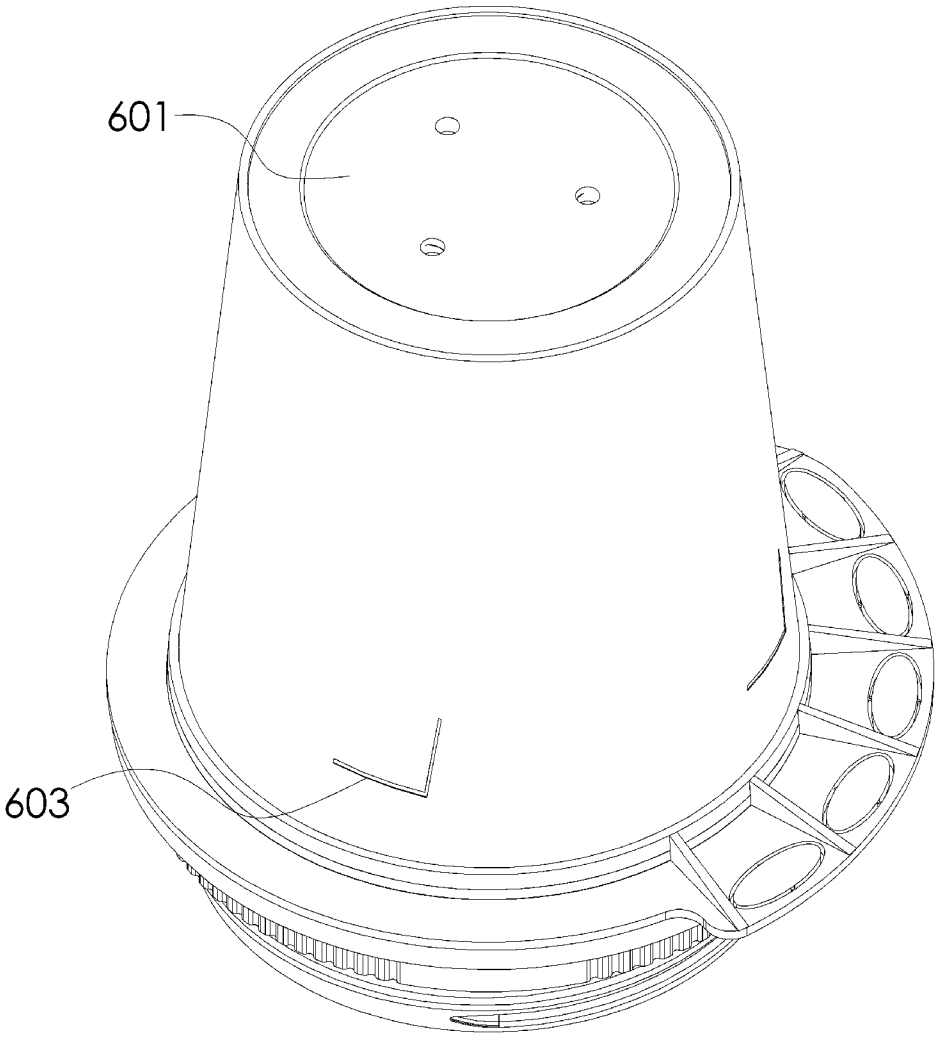
FIG. 6 is a bottom view of the housing of the pill container with detents, according to some of the disclosed embodiments.

FIG. 6 is a bottom view of the housing of the pill container with detents, according to some of the disclosed embodiments. The detents, and/or holes or indentations are located at the bottom base 601 of the pill container 200. Depending on the size of the pill container, the location and number of holes may vary. For example, in a smaller size vial, there may be lesser holes due to the amount of real estate at the bottom base as opposed to a larger vial which may contain a larger number of holes. Alternatively, the same locations and number of holes may be at the base of a vial regardless of its size so that they may fit into the same location in the tab removal machine.

The pill container 200 also contains a section for a label, the labeling area 603. The label to be placed in the labeling area 603 includes information pertinent to the vial and the patient. For example, the label may include patient name, contents of the vial, such as the name of the medication, regimen details, such as number of pill enclosed in the vial as well as the days and/or times of the day when the medication is to be taken. The label may also contain any additional information necessary for the patient to administer the medication or other information that is provided by the doctor, manufacturer of medication, or required on the label due to state/federal regulation. The label information may be regular text, large text, or in braille as needed.

The location of the label is defined by the marked section 603 where the corner of a rectangular label is to start in the marked section and to wrap around the vial until it reaches the other marked section. Since the vial is a circular and tapered vial, the system calculates the size and length of the vial as well as the shape such that once wrapped, the label does not wrinkle due to the tapered shape of the housing. The system determines the right size of the sticky label required and automates the process of placing a label on the vial such that its placed accurately within the marked areas in an expeditious manner.

Figure 7:
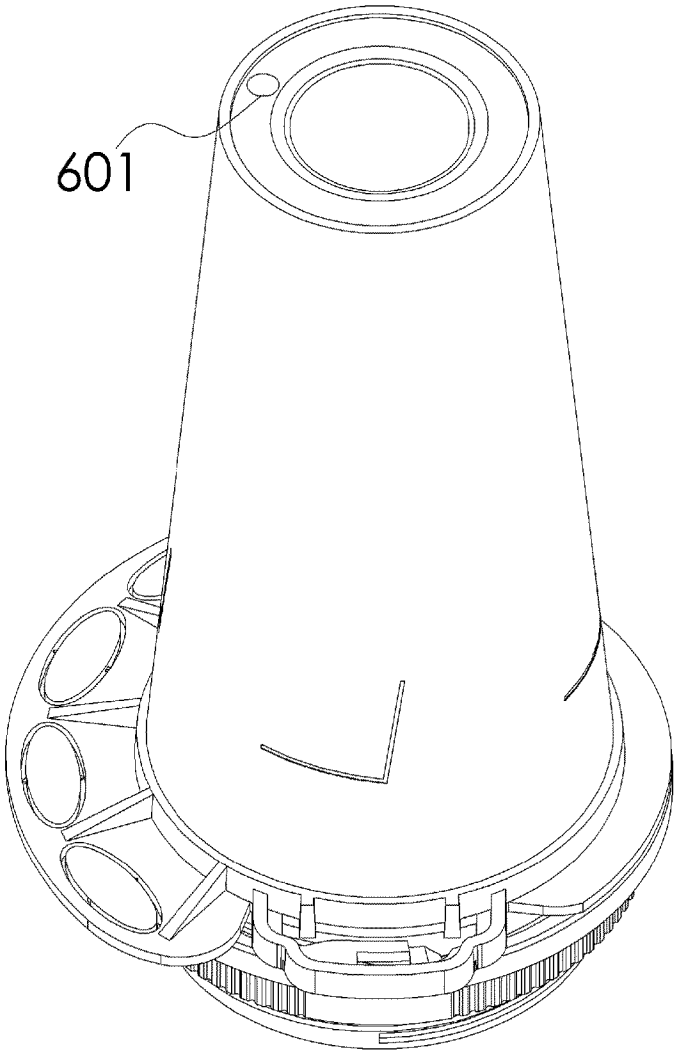
FIG. 7 is a bottom view of the housing of the pill container with a detent, according to some of the disclosed embodiments.

FIG. 7 is a bottom view of the housing of the pill container with a detent, according to some of the disclosed embodiments. In one embodiment, the pill container/vial of FIG. 7 is a smaller pill container 200. The smaller pill container 200 will hold a smaller number of pills. All the other features, breakable tabs, of the pill container 200 are same as the pill container of FIG. 6. In one embodiment, the smaller pill container 200 includes one detent/hole/indentation. The location of the hole from the center of the pill container may be the same distance as the locations of holes in FIG. 6 from the center of the pill container shown in FIG. 6. Alternatively, the location of the hole may be situated such that once it is placed on the tab removal machine, the hole at the base of the housing aligns with a probe or protrusion that can be inserted inside the hole for alignment and locking.

Figure 8:
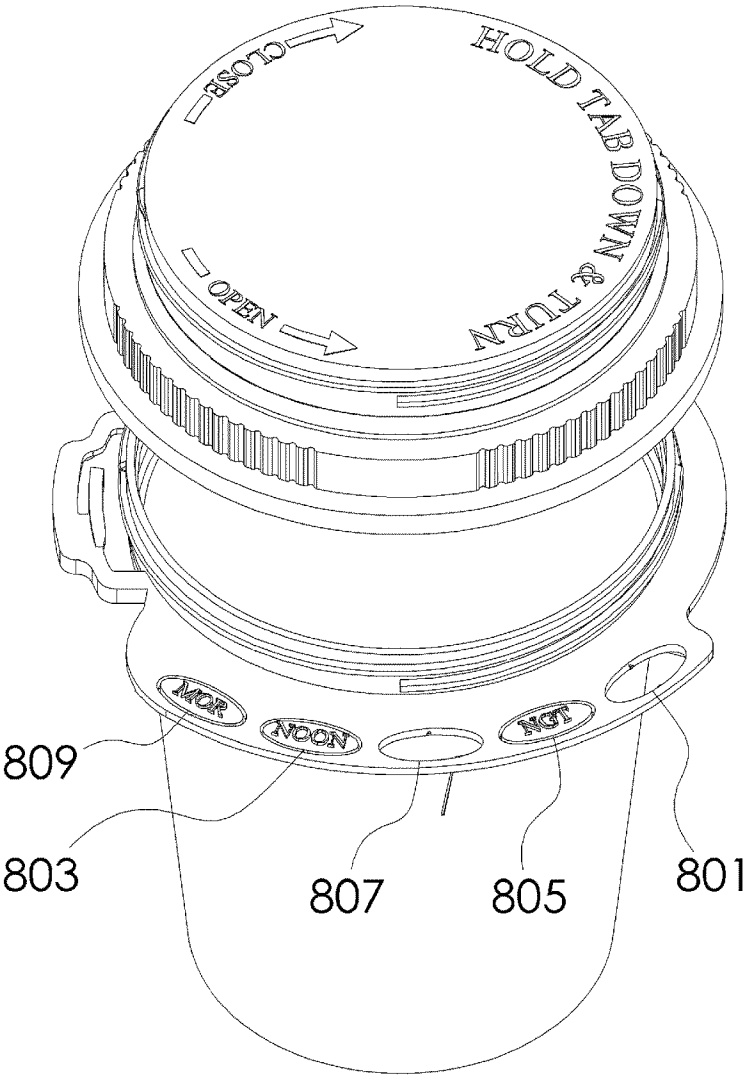
FIG. 8 is a perspective view of the pill container assembly with desired tabs removed from the flange, according to some of the disclosed embodiments.

FIG. 8 is a perspective view of the pill container assembly with desired tabs removed from the flange, according to some of the disclosed embodiments. The pill container assembly includes a pill container housing and a cap. The pill container housing includes a flange having removable tabs, such as tabs for PRN 801, Night 805, Evening 807, Afternoon or Noon 803, and Morning 809. Each of the tabs includes a perforation around them allowing them to be easily broken off from the flange when a certain force is applied.

In this embodiment, the patient for which this pill container is being used is required to take certain medications that will be stored inside this pill container during Morning, Afternoon, and Night. They are not supposed to take the medication at any other time, and definitely not in evening or another customized time (PRN). Since the pill container has removable tabs for Morning, Afternoon, Evening, Night, and PRN, FIG. 8 depicts a pill container that has undergone processing through the tab removal machine, where the tabs that were not needed for this patient, i.e., Evening and PRN, were removed by applying a force and breaking them through the flange along their perforated areas. The completed pill container now includes the desired tabs, Morning, Afternoon, and Night and has a hole in other places. A patient may simply peruse their fingers over the flange of the bottle to determine the times that the medication is to be taken and then take the medications accordingly. The empty holes would alert the patient when not to take the medication without having to read labels.

Figure 9:
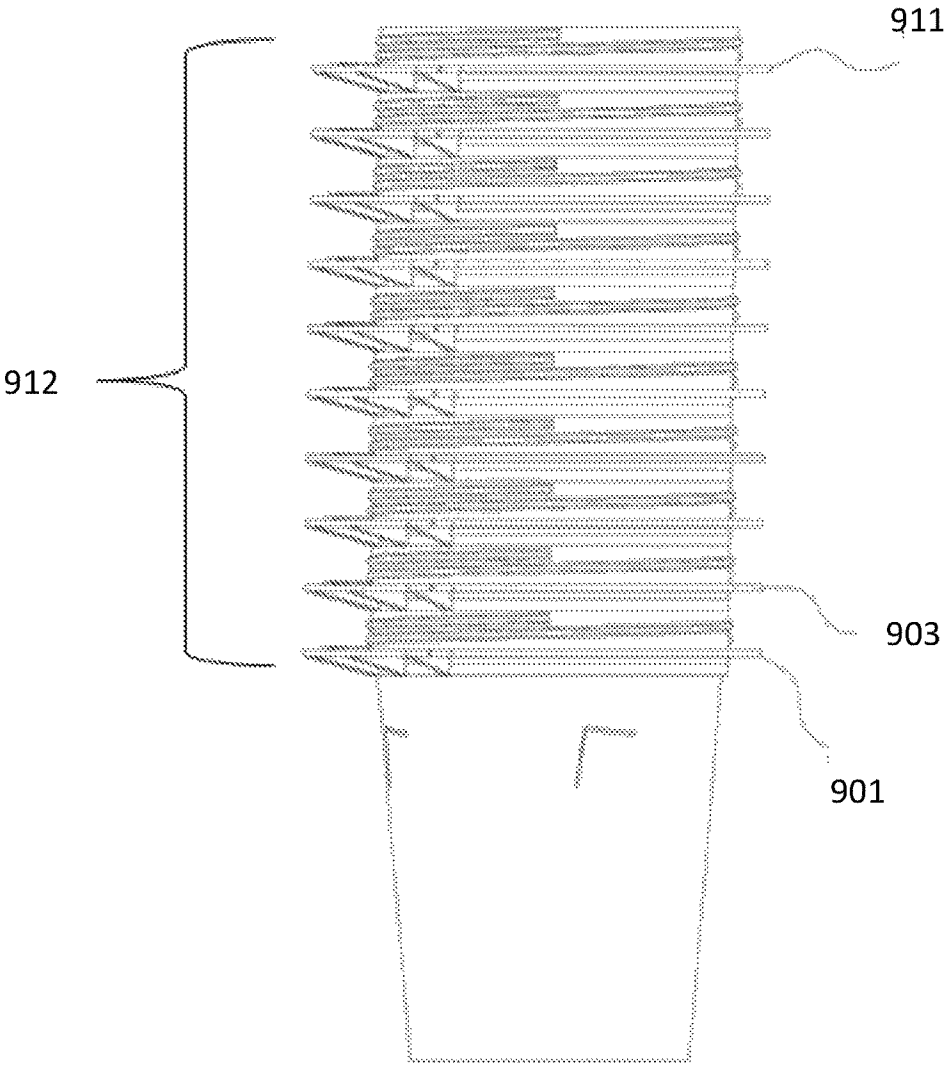
FIG. 9 is a front view of a plurality of pill containers stacked within each other, according to some of the disclosed embodiments.

FIG. 9 is a front view of a plurality of pill containers stacked within each other, according to some of the disclosed embodiments. As mentioned in FIG. 4 above, the housing of the pill container is tapered and cylindrical in shape. The tapering allows for a wider top section and a narrower bottom and the tapered body in-between. The tapering body allows for Pill Containers 901 through 911 to be stacked within each other. A tapering angle that allows for a minimal stacking height 912 may be used. For example, a pill container with the tapering angle that allows maximum insertion of a second pill container within will be preferred to optimize the storage height 912.

Figure 10:
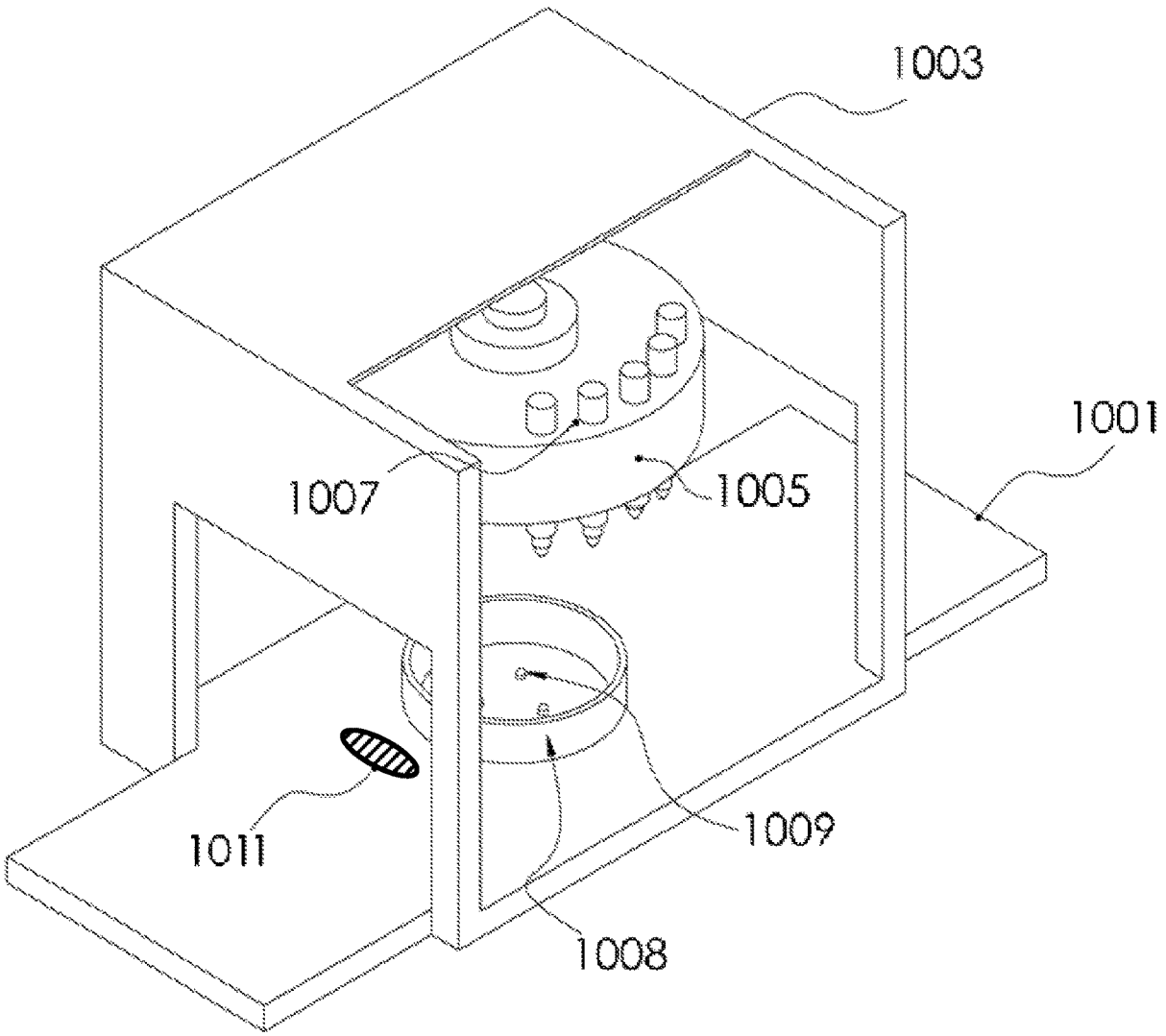
FIG. 10 is a detailed view of one exemplary tab removal machine, according to some of the disclosed embodiments.

FIG. 10 is a perspective view of the tab removal machine, according to some of the disclosed embodiments. The tab removal machine 1000 includes a base 1001, a cover 1003, a tab breaking mechanism 1005, a placement area 1008, and a locking/alignment protrusion 1009.

The base 1001 includes a circular protrusion 1008 that allows insertion of the base/bottom of a pill container 200. The circular protrusion 1008 is a round circular ring with a hollow inside with the base 1001 as a bottom. The circular protrusion 1008 may be coupled to the base 1001 through a variety of means, such as adhesive, fit into a circular rail or indentation, or screwed onto mating threads at the base 1008. The diameter of the circular protrusion 1008, i.e. the circular ring, provides a snug fit for the base/bottom of the pill container 200 such that once the pill container 200 is inserted inside the base 1008; it is unable to move in any direction of the XY Plane. The protrusions may be of different sizes and the round circular protrusion ring may be switched with a different size ring to accommodate for pill containers of various sizes.

Further, in one embodiment, the circular protrusion 1008 may be divided into two pieces, where the first piece of the ring is fixed and the second piece is attached to the first piece through a joint that allows the second piece to open as a door and allow for easy insertion of the pill container 200. In operation, in this embodiment, when a pill container is to be inserted inside the ring circular protrusion, the second piece may be opened as a door thereby allowing an opening to insert the pill container in the circular protrusion 1008 and then closing the second piece back to lock the pill container 200 within the ring.

Inside the circular protrusion 1008, and coupled to the base 1001 of the tab removal machine 1000, there is a plurality of small locking/alignment protrusions 1009 (or small pistons or cylindrical sticklike protrusions). These locking/alignment protrusions 1009 are to be inserted in the holes (505, 507, 509, and 601) of the pill container 200.

As mentioned earlier, depending on the type of pill container, there may be one or more holes at the base of the pill container 200. The locking/alignment protrusions 1009 of the tab removal machine 1000 fit inside the holes of the pill container 200 to align the pill container 200 with respect to the tab removal machine 1000. The alignment ensures both that the pill container 200 is placed at a desired location on the XY plane as well as it is rotated to the desired side such that the pill container's 200 tabs section 205 fits directly underneath the tab breaking mechanism 1005 with the removable tabs of the pill container aligned underneath the pistons/plungers of the tab breaking mechanism 1005. Further, the alignment also ensures that the label section of the pill container is facing outward from the tab removal machine such that the label area can be accessed from the outside and a label can be placed easily. If the orientation of the pill container is incorrect, i.e. where the label section is not facing the desired side, then the pill container is rotated until they are in the desired location. In one instance, the labeling is automated such that the system obtains the information from a database, prints the information on the label, and sticks the label on the pill container.

In the embodiments in which the pill container includes one hole at its base, the system may detect it as such and only insert the appropriate locking/alignment protrusion 1009 into the single hole such that the removable tabs of that pill container 200 also align with the tab breaking mechanism, 1005 above. The locking/alignment protrusions 1008, along with the circular ring protrusion, together align the pill container 200 underneath the tab breaking mechanism 1005 as well as lock the pill container in place so that it may not move in the XY plane.

The tab breaking mechanism 1005 includes a plurality of pistons or plungers (or probes) 1007. These pistons are cylindrical and circular in shape. Alternatively, the pistons may come in several other shapes, such as oval. The cylindrical pistons have the ability to move up and down the Z axis of the tab removal machine 1000. Each piston can apply a concentrated force onto the removable tab of the pill container 200 such that once the force is applied on a selected tab from the removable tabs 114, the selected removable tab is pushed therethrough along the perforated lines.

The tab breaking mechanism 1005 may also be moved up/down along the Z-Axis. In one embodiment, tab breaking mechanism 1005 is moved vertically upwards along the Z-Axis to a height that provides a clearance for inserting a pill container 200 inside the circular protrusion 1008. Once inserted, the tab breaking mechanism 1005 is lowered back such that it sits above the pill container 200 and prevents movement of the pill container in the Z-Axis. As such, the pill container 200 is restricted in all axis before the tab breaking is begun to prevent any movement during the tab breaking that may cause errors of breaking of other undesired sections of the pill container 200.

Sample Operation

One sample method of removing the removable tabs is described below. The tab removal method utilizes a tab removal machine that engages with the pill container to selectively remove or break one or more tabs that are labeled with an HOA.

The steps of sample process can be executed using a processor of the computer. Likewise, a variety of multiprocessor systems, microprocessor-based or programmable consumer electronics can also be used. The logic to execute the steps and make a decision can be saved in memory, such as RAM and stored on a CPU.

In operation, the tab removal machine communicates with a database that stores patient information, including prescriptions, patient history, and medication information associated with that specific patient. The medication information may also include patient information, such as patient name, birth date, types of prescriptions and pills designated for the patient and other patient data relevant and needed by the pharmacies or the system to operate. The medication information also includes types and quantities of pills and their hours of administration (HOA). The tab removal machine may obtain one or more pieces of information that are relevant to a specific pill container that it will be processing.

The tab removal machine locks the pill container placed within so it cannot be moved during the tab removal operation. The tab removable machine then uses a barcode reader or an RFID reader 1011 to read the barcode or tag placed on the pill container. Although the location and positioning of the RFID/barcode tag reader 1011 is located at the bottom of the tab removable machine at 1011, other locations and positioning of the RFID/barcode tag reader 1011 is also contemplated.

Once the information is obtained, the tab removal machine correlates that data with the database that stores patient's pill intake hours of administration (HOA). The goal of this verification to ensure that the right pill container that is a match for the specific patient is being processed. Once verified, inserts a probe into various tabs of the pill container thereby applying a pressure to punch the tab through the flange until it falls out. The tab removal machine determines which tabs to remove from the tab section of the pill container based on the prescribed Hour of Administration.

For example, the pill container may be associated with a prescription plan for that specific patient that requires a certain medication, such as Tylenol, to be taken twice a day, once in morning and once at nighttime. In this example, the tab removal machine determines the number and type of tabs currently on the pill container. If the pill container contains tabs for morning, afternoon, evening, and night, i.e., 4 tabs for 4 HOAs, then the tab removal machine will punch through/remove the tabs for afternoon and evening leaving behind the tabs for morning and nighttime. The end product will just have two tabs making it easy for the user to determine that HOAs for that specific container. Likewise, if the pill container contains tabs for morning, afternoon, and night, i.e. 3 tabs for 4 HOAs, then the tab removal machine will punch through/remove just one afternoon tab leaving behind the tabs for morning and nighttime. The tab removal machine has the ability to read the current tabs before processing, i.e. punching through.

Likewise, if the prescription calls for just one HOA, e.g. afternoon, then the tab removal machine will punch through all the other tabs that are for different HOAs and leave behind just the tab for afternoon. As such, one or more tabs will be removed based on HOA for each specific patient.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims.

What is claimed is:

1. A pill container assembly for storing a plurality of medical pills for a specific patient comprising:

a longitudinally tapered cylindrical housing having a top and a bottom, a wall that connects the top and the bottom forming a surrounding to a hollow enclosure for storing medical pills, wherein the top has an opening to the above, the bottom provides a floor to the housing, wherein the diameter of the top opening is wider than the diameter of the bottom, the surrounding wall having an exterior surface that is outside of the hollow enclosure and an interior surface that is the inside of the hollow enclosure, the bottom including a detent;

a flange protruding outward from the top of the housing from the exterior surface, wherein the flange includes a locking feature;

a plurality of removable tabs located within the flange, wherein each removable tab is labeled with an hour of administration (HOA), wherein the HOA represents the timing of the day at which a patient may intake medications stored within the pill container, wherein a plurality of perforations surrounds each of the plurality of the removable tabs thereby allowing the breaking away of a removable tab along the lines of perforations upon applying a pressure;

a locking feature at the top of the housing, wherein the locking feature includes a locking means and an engaging means; and a threaded cap, wherein the threaded cap engaged with the locking and engaging means at the top of the housing results in closing the top part of the housing that has an opening to the above and encapsulating the pill container such that medications inside the container are secured from the outside.

2. The pill container assembly of claim 1, wherein the longitudinally tapered cylindrical housing allows one pill container to be stored within another pill container thereby allowing a plurality of pill containers to be stacked within each other.

3. The pill container assembly of claim 1, wherein a tab associated with a certain HOA is removed, wherein such removal is performed using a tab removing machine that applies a force on a tab that is to be removed and forcibly pushes the inside of the perforated section of the tab to remove it from the tab.

4. The pill container assembly of claim 3, wherein only relevant HOA tab or tabs are retained and the remaining irrelevant tabs are removed by the tab removing machine, wherein the relevant HOA tab or tabs that are retained are those tabs that represent the timing of the day at which a patient may intake the medications and the irrelevant tabs that are removed are those tabs designated with a timing at which the medication is not to be taken, wherein a destination as to which tabs are relevant and which tabs are irrelevant is obtained by the tab removing machine by accessing a database that stores patient's HOA information.

5. The pill container assembly of claim 4, wherein the relevant HOA tab is a morning tab.

6. The pill container assembly of claim 4, wherein the relevant HOA tab is an afternoon tab.

7. The pill container assembly of claim 4, wherein the relevant HOA tab is an evening tab.

8. The pill container assembly of claim 4, wherein the relevant HOA tab is a night tab.

9. The pill container assembly of claim 4, wherein the relevant HOA tab is a custom tab that has a desired label on it.

10. The pill container assembly of claim 4, wherein the relevant HOA tab is a desired time, wherein the desired time identifies the time at which the pills stored inside the pill container may be taken by the patient.

11. The pill container assembly of claim 4, wherein the longitudinally tapered cylindrical housing is tapered at an angle that allows insertion of another same size pill container through its wide opening at the top thereby allowing multiple pill containers to be stacked within each other for storage.

12. The pill container assembly of claim 1, further comprising reading a radio frequency identification (RFID) tag that is connected to the pill container, wherein the RFID tag includes information about the patient and their pill hour of administration (HOA).

13. The pill container assembly of claim 1, further comprising a magnifying lens situated in the cap of the pill container.

14. The pill container assembly of claim 13, wherein the magnifying lens allows a user to see through the cap and view objects and writing in a magnified manner for easy reading and viewing.

15. The pill container assembly of claim 13, wherein the magnifying lens is either locked inside the cap or removable from the cap.

16. The pill container assembly of claim 15, wherein the removed magnifying lens can be replaced with a magnifying lens of different magnification or a prescription glass.

17. The pill container assembly of claim 13, wherein the contents of the pill container can be viewed through the magnifying lens while the cap is in a closed position with the pill container.

18. The pill container assembly of claim 13, wherein the magnifying lens is made of either plastic or glass.

19. The pill container assembly of claim 13, wherein the magnifying lens is part of the cap housing such that it cannot be separated or removed from the cap.

* * * * *